US007509779B2

(12) United States Patent
Makovich

(10) Patent No.: US 7,509,779 B2
(45) Date of Patent: Mar. 31, 2009

(54) LIGHTWEIGHT BUILDING BLOCKS

(76) Inventor: Joseph J. Makovich, 6 Winterset Dr., Norwalk, CT (US) 06851

( * ) Notice: Subject to any disclaimer, the term of this patent is extended or adjusted under 35 U.S.C. 154(b) by 517 days.

(21) Appl. No.: 10/966,410

(22) Filed: Oct. 15, 2004

(65) Prior Publication Data

US 2005/0252134 A1 Nov. 17, 2005

Related U.S. Application Data

(60) Provisional application No. 60/523,531, filed on Nov. 19, 2003.

(51) Int. Cl.
*E04B 2/00* (2006.01)

(52) U.S. Cl. ..... 52/426; 52/309.4; 52/503; 52/566.2

(58) Field of Classification Search ..... 52/596, 52/600, 604, 606, 612, 309.4, 309.7, 309.8, 52/503, 309.11, 309.16, 425, 426, 586.2
See application file for complete search history.

(56) References Cited

U.S. PATENT DOCUMENTS

| | | | | |
|---|---|---|---|---|
| 1,780,086 | A * | 10/1930 | Linn | 52/515 |
| 4,577,447 | A | 3/1986 | Doran | 52/571 |
| 4,614,071 | A | 9/1986 | Sams et al. | 52/309.12 |
| 4,731,279 | A | 3/1988 | Isshiki | 428/159 |
| 4,884,382 | A * | 12/1989 | Horobin | 52/426 |
| 4,984,403 | A * | 1/1991 | Zarwell | 52/476 |
| 5,457,926 | A * | 10/1995 | Jensen | 52/604 |
| 5,699,640 | A | 12/1997 | Bourgeois et al. | 52/309.4 |
| 5,771,654 | A | 6/1998 | Moore et al. | 52/742.14 |
| 5,901,520 | A * | 5/1999 | Abdul-Baki | 52/592.6 |
| 5,983,585 | A * | 11/1999 | Spakousky | 52/405.4 |
| 6,276,104 | B1 * | 8/2001 | Long et al. | 52/309.4 |
| 6,412,243 | B1 * | 7/2002 | Sutelan | 52/309.7 |
| 6,889,479 | B2 * | 5/2005 | Thorpe | 52/596 |
| 2001/0029717 | A1 * | 10/2001 | Spakousky | 52/405.4 |

* cited by examiner

*Primary Examiner*—Richard E Chilcot, Jr.
*Assistant Examiner*—Anthony N Bartosik
(74) *Attorney, Agent, or Firm*—Ohlandt, Greeley, Ruggiero & Perle, LLP.

(57) ABSTRACT

A building block for construction of a structure, such as house, is provided that is lightweight and portable. The building block has a first or lightweight portion that can be made from a thermally insulative material. The building block also has a second or rigid portion that can be made from a material having a high compressive strength. The first and second portions are affixed to each other to provide a preformed building block with a high compressive strength. The rigid portion can be a number of rigid sheets substantially embedded in the lightweight portion.

21 Claims, 5 Drawing Sheets

LIGHTWEIGHT BUILDING BLOCKS

CROSS-REFERENCE TO RELATED APPLICATIONS

This application is related to, and claims priority in, U.S. Provisional Patent Application Ser. No. 60/523,531, filed on Nov. 19, 2003 for "Lightweight Building Blocks", the disclosure of which is incorporated by reference herein.

BACKGROUND OF THE INVENTION

1. Field of the Invention

This invention relates to improved lightweight building blocks, and more particularly, to reinforced foam building blocks which may be used to replace heavy cement building blocks such as those used in the construction of buildings in a wide variety of applications where portability and lightweight are advantageous.

2. Description of the Related Art

Lightweight foam structures have been previously used for a number of ornamental applications. But for military applications and sporting requirements such as temporary camp establishments, there has been a need for providing new and improved building blocks, which may be used as a substitute for the conventional cement building blocks in specific applications where lightweight portability is a significant advantage.

U.S. Pat. No. 4,577,447 to Doran discloses construction blocks made from expanded polystyrene beads. The Doran construction blocks are designed to be used with a concrete footing, and separate steel reinforcement rods and pourable masonry cement. The Doran blocks are seated upon the concrete footing, and over the steel reinforcement rods that extend vertically from the footing. The liquid concrete is poured into the spaces in the Doran blocks to provide support. The disadvantage of the Doran blocks is that they lack support without the use of the separate liquid concrete and reinforcement rods.

U.S. Pat. No. 4,614,071 to Sams et al. discloses a building block having a polyurethane or polystyrene body that is sandwiched between a pair of cement slabs. The building blocks are intended to provide thermal insulation and fire resistance. The disadvantage of the Sams building blocks is that the cement slabs, which provide the needed support for the blocks, also provide added weight, which limits their usefulness for portability.

U.S. Pat. No. 4,731,279 to Isshiki discloses assembly blocks that can be used for tables, stools, gates, arches and the like. The Isshiki blocks are made from a polyolefin resin, and have male and female projections as interconnecting structures. The Isshiki blocks are provided with a central bore so that a separate reinforcing bar, such as a metal bar, can be slid through the blocks. The disadvantage of the Isshiki blocks is their need for the use of a separate reinforcement bar, which limits their usefulness as a fast, lightweight construction material. Additionally, the use of the reinforcement bar that is slid through the central bores provides limited support to the block itself.

U.S. Pat. No. 5,699,640 to Bourgeois discloses wall sections that are made from expanded polystyrene. The wall sections are about four feet in length and include a plurality of cells that each have central cavities therethrough which are filled with separate steel reinforcement bars and concrete. The disadvantage of the Bourgeois wall sections is that they lack support without the use of the separate concrete and reinforcement bars.

U.S. Pat. No. 5,771,654 to Moore et al. discloses a method of construction using molded polymer blocks. The method employs a number of the polymer blocks that have a passage portion, which defines a lattice system for receipt of poured concrete. The block system acts as a form for the concrete but also provides for the aesthetics of the structure. The disadvantage of the Moore construction system that it lacks support without the use of the separately poured concrete.

Accordingly, it is a general object of this invention to provide lightweight building blocks with a novel and efficient construction.

Another object of the invention is to provide improved lightweight building blocks, which each include a plurality of exterior walls constructed of reinforced foam insulation material.

An additional object of the invention is to provide an improved lightweight foam building block, such as, for example, a STYROFOAM® building block with a plurality of external walls joined together by interconnected cross-members.

A still further object of this invention is to provide an improved lightweight building block which includes a plurality of foam or STYROFOAM® sides connected together by a plurality of foam or STYROFOAM® cross-members interconnected thereto by a rigid reinforcing material.

SUMMARY OF THE INVENTION

In carrying out the invention, in one form thereof, it is applied to a lightweight foam building block, which may be made to any practical size, such as those of conventional cement building blocks. The two elongated STYROFOAM® sides of the block are arranged in spaced apart parallel relationship, and joined together by three parallel STYROFOAM® cross-members, each of which is in perpendicular relationship to elongated sides of the block. The cross-members each include a thin intermediate sheet of rigid reinforcing material, such as, for example, LEXAN® plastic, which protrudes from each side of the cross-member and fits into communicating slots in the elongated STYROFOAM® sides of the block. The five STYROFOAM® components, together with the interconnecting sheets of reinforcing material are bonded together by epoxy to form the finished block. The finished lightweight blocks may then be luted together to form a desired block structure by using a suitable foam compatible adhesive, such as silicone caulking material.

In one aspect of the invention, a building block for construction of a structure is provided, where the building block comprises first and second portions. The first portion is made from a lightweight material and the second portion includes a rigid material. The first and second portions are affixed to each other. The building block has a size and shape that allows it to be connected to another of the building blocks for construction of the structure. The building block is preformed.

In another aspect of the invention, a building block for construction of a structure is provided, where the building block comprises a lightweight portion and a rigid portion. The rigid portion has a high compressive strength. The lightweight portion and the rigid portion are affixed to each other. The building block has a size and shape that allows it to be connected to another of the building blocks for construction of the structure. The building block is preformed and has a weight of less than about 3 pounds.

The rigid material can have a high compressive strength. The second or rigid portion can be substantially embedded in the first or lightweight portion. The second or rigid portion may be a plurality of second or rigid portions affixed to the first or lightweight portion. The first or lightweight portion can have at least one cavity formed therethrough. The plurality of second or rigid portions may be disposed substantially parallel to each other. Pairs of second or rigid portions can be spaced apart by one or more of the cavities. The second or rigid portion may have a rectangular shape or a cylindrical shape.

The building block can have a compressive strength at failure of greater than 8,330 pounds per square inch. The building block can have opposing sides that are tapered. The building block can have one or more tongue and groove connectors that are partially defined by a portion of the second or rigid portion extending from the first or lightweight portion. The second or rigid portion can have a height, a width and a thickness, where the height and width are substantially greater than the thickness. The lightweight material may be a polystyrene having a high thermal insulation value. The first or lightweight portion and the second or rigid portion can be affixed to each other by an adhesive. The rigid material may be a polycarbonate.

Further aspects of the invention will become apparent hereinafter, and the specification concludes with claims particularly pointing out and distinctly claiming the subject matter, which is regarded as the invention.

The invention, as to organization and method of operation, together with other objects and advantages thereof, may best be understood by reference to the following description when taken in conjunction with the accompanying drawings, in which:

DETAILED DESCRIPTION OF THE INVENTION

Figure 2:
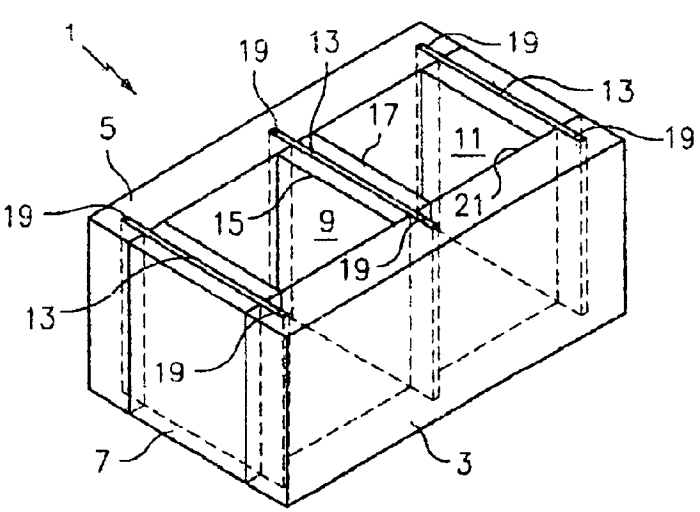
FIG. 2 is a top and end elevation and perspective view of the building block of FIG. 1.
Figure 4:
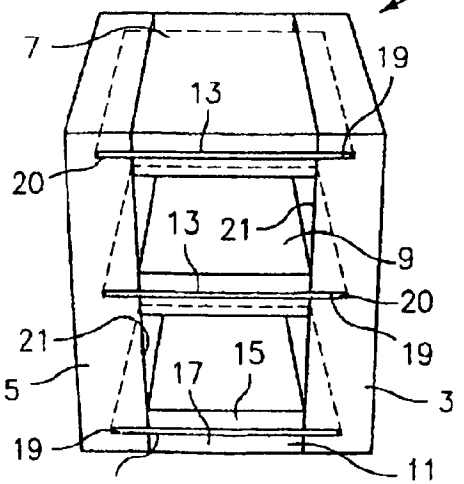
FIG. 4 is a top elevation and perspective view of the building block of FIG. 1 with the block rotated 90 degrees from that shown in FIG. 3.
Figure 1:
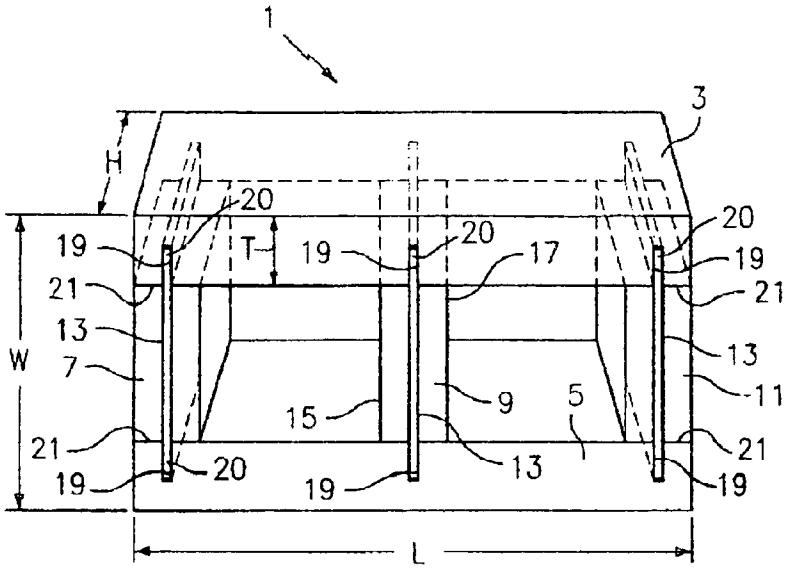
FIG. 1 is a top elevation and perspective view of an improved lightweight building block embodying the invention.

Referring first in detail to the drawings, and in particular to FIGS. 1 to 4, there is shown a lightweight building block 1 in which the invention may be advantageously employed. In this embodiment of the invention, block 1 is made of reinforced foam, such as, for example, an extruded or expanded polystyrene plastic, such as STYROFOAM®, with external nominal dimensions, as shown in FIG. 1, of L=16 inches length by W=8 inches width by H=8 inches height. These dimensions are similar to the dimensions of standard stretcher type cement building blocks, which usually have more specific dimensions of L=15.625 inches length by W=7.625 inches width by H=7.625 inches height to allow appropriate spacing for mortar or similar material to be interposed between the cement building blocks when they are placed alongside of, above and below each other in a building structure. Block 1 could also be constructed with the dimensions L, W, and H of any other practical size building block, while also incorporating the benefits of the invention. The specific or exact external dimensions L, W, and H of block 1 will have a tolerance to provide spacing for a foam compatible adhesive such as epoxy glue to attach the blocks 1 together.

In the embodiment of the invention disclosed in FIGS. 1-4, upper elongated side 3 and lower elongated side 5 of block 1 are rectangular in shape, made from two inch thick BLUE STYROFOAM® insulation material, and joined together by cross-members 7, 9, and 11, which are each in perpendicular relationship to the upper and lower sides 3 and 5. The nominal dimensions of each of the two sides 3 and 5 measure L=16 inches long by H=8 inches wide, by T=2 inches in thickness (as in FIG. 1). Sides 3 and 5 are disposed in spaced apart parallel relationship to each other by their contiguous attachment to cross-members 7, 9 and 11.

Figure 3:
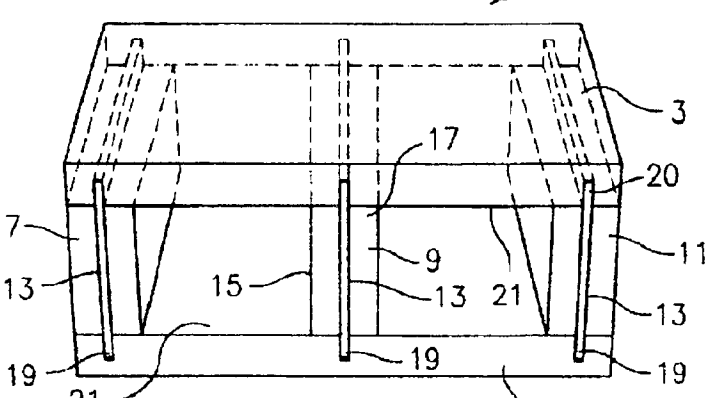
FIG. 3 is a top elevation and perspective view of the building block of FIG. 1, which is similar to FIG. 1.

Cross-members 7, 9, and 11 are also made from BLUE STYROFOAM® insulation material, and they each comprise a sheet 13 of rigid reinforcing material, such as, for example, polycarbonate resin, such as LEXAN®, sandwiched between two parallel cross-member sections 15 and 17 of one inch thick BLUE STYROFOAM® insulation material, which like the sides 3 and 5 are rectangular in shape. The nominal external dimensions of cross-members 7, 9 and 11, viewing FIGS. 1 and 3, are 4 inches in the direction of the width W of the block 1, by 8 inches in the direction of the height H, by 2.125 inches thick, with each of their cross-member sections 15 and 17 being one half the thickness of the side members 3 and 5, or one inch thick, spaced apart and parallel to their sandwiched and interposed reinforcing sheet 13, which is 0.125 inches thick. Reinforcing sheets 13 of rigid material have nominal external dimensions of 6 inches in the direction of the width W of the block 1, by 8 inches in the direction of the height H, by 0.125 inches thick, so that the sheets 13 of LEXAN® plastic protrude by one inch from each side of the cross-members 7, 9, and 11 (as in FIG. 1). While the present disclosure describes the LEXAN® sheets 13 being sandwiched or embedded in the insulation, the present disclosure contemplates other configurations of the lightweight and rigid portions, such as, for example, the rigid sheets being disposed on the outer surface or perimeter of the building block 1.

Cross-members 7, 9, and 11 are each connected to the oppositely disposed and parallel inner ends and middle of elongated sides 3 and 5 by means of parallel slots 19 formed or cut in each inside face 21 of block sides 3 and 5 near their outer ends and in the middle to accommodate and cooperate with protruding ends 20 of the LEXAN® sheets 13 that are fitted into the slots 19 (as in FIG. 1). The LEXAN® plastic material of sheets 13 protrudes by 1 inch from each of the inside faces of the sides 3 and 5 of block 1 to provide ends 20 that fit into the slots 19, which are slightly deeper than the extent of 1 inch protrusion of sheets 13. The five components 3, 5, 7, 9, and 11 of each reinforced STYROFOAM®D building block 1 are luted together by using a foam compatible adhesive, such as epoxy glue. The components 3, 5, 7, 9, and 11 can have other structures to facilitate bonding and support of the building block 1, such as, for example, connectors or interconnecting portions to allow for a mechanical lock therebetween.

Figure 5:
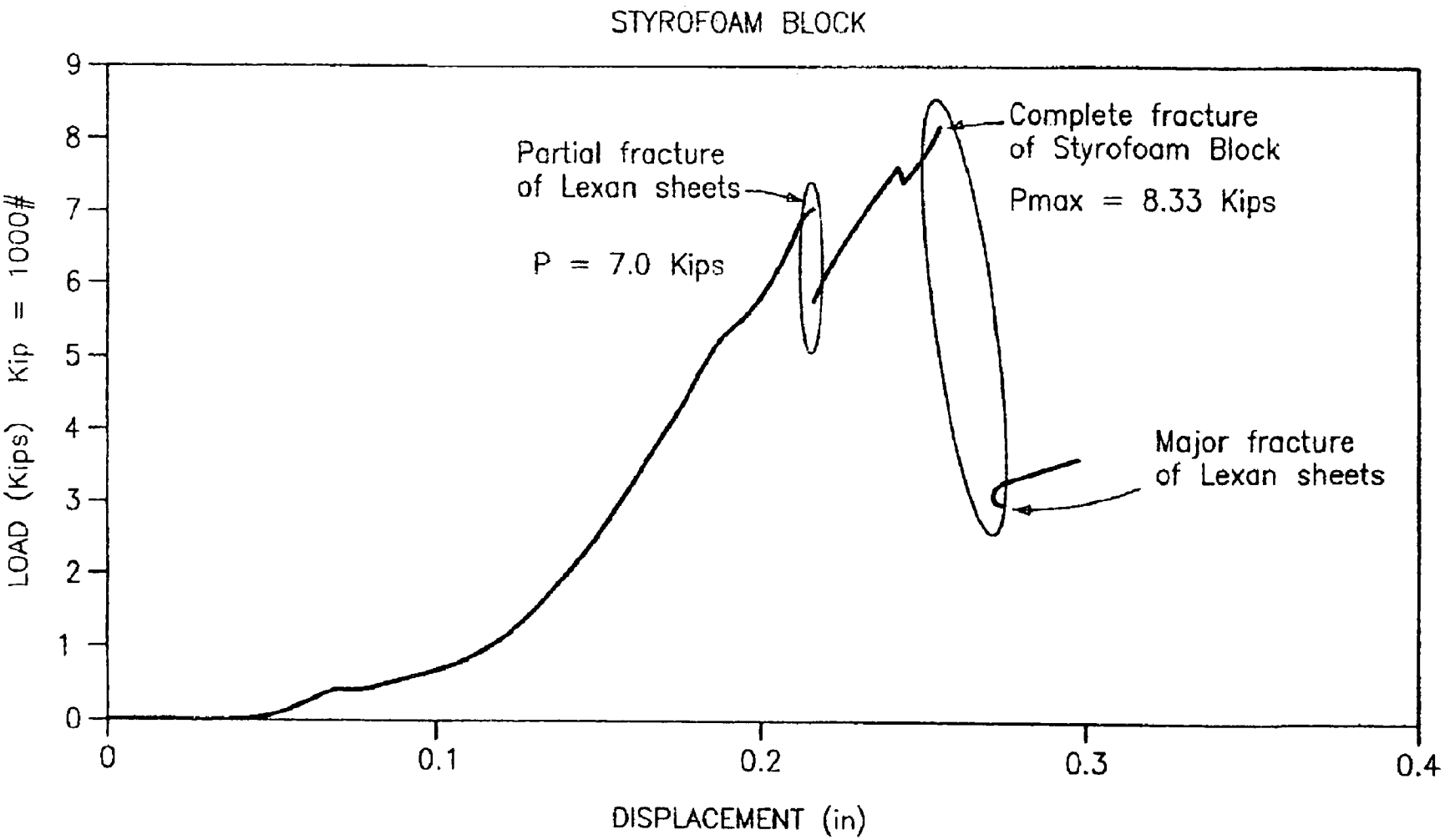
FIG. 5 is a graph showing the results of a pressure test conducted on a STYROFOAM® building block of this invention by Clarkson University.

A prototype block similar in dimensions to the lightweight building block 1 (i.e. L=16 inches length by W=7 inches width by H=9.5 inches height) which was tested for crushing strength by the Engineering Department of Clarkson University, withstood at least 7,000 pounds per square inch (7.00 KIPS) of pressure before it failed. The results of this test are shown in the graphic plot of FIG. 5, where the ordinate represents the load in pounds per square inch, and the abscissa shows the displacement in square inches of the prototype block, which was tested by Clarkson University. As shown in this graphic representation of the test results, partial fracture of the LEXAN® reinforcing sheets occurred at a load approximating 7,000 pounds per square inch (7.0 KIPS), and a complete failure of the prototype block occurred at 8,330 pounds per square inch (8.33 KIPS).

It will be understood by those skilled in the art that other variations of block size, and reinforcing materials may be utilized in conjunction with the present invention. For the principal block 1 components 3, 5, 7, 9, and 11, other types of foam besides STYROFOAM® could also be utilized, and plastics, laminates and wood could be used instead of the rigid reinforcing material of LEXAN® which was used for sheet 13, where such materials preferably have a high compressive strength.

Figure 8:
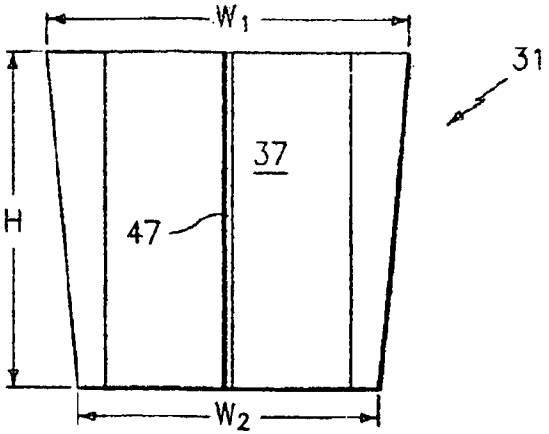
FIG. 8 is a slotted end view of the tapered building block of FIGS. 6 and 7.
Figure 9:
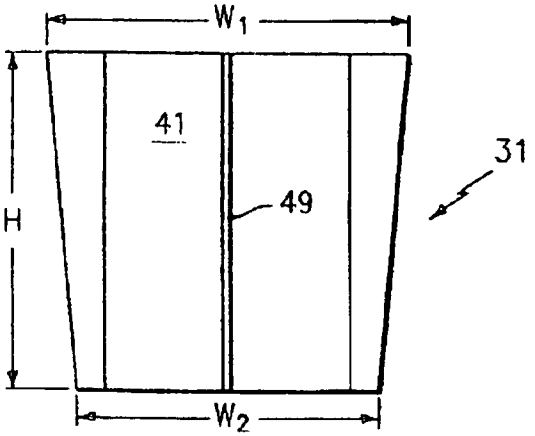
FIG. 9 is a reverse end view of the tapered building block of FIGS. 6 and 7, with a LEXAN® reinforcing strip protruding from one end thereof.
Figure 6:
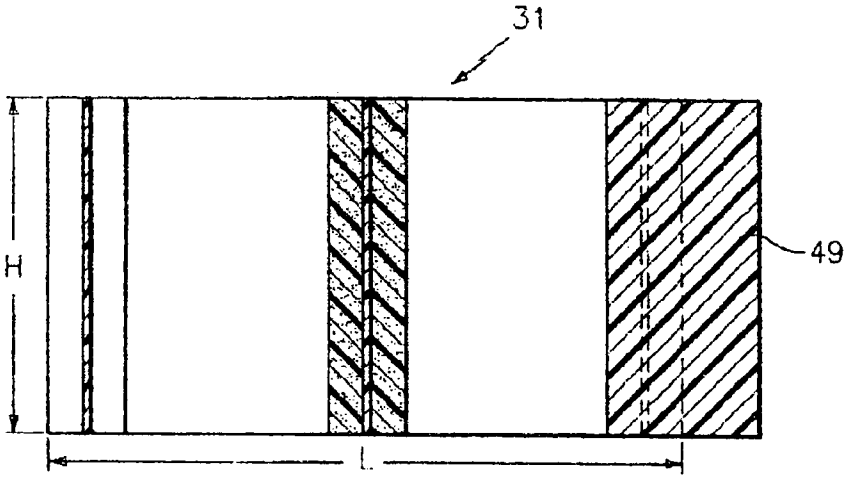
FIG. 6 is a mid sectional view taken along the lines 6-6 of FIG. 7, of a first alternative embodiment of the invention, which is a tapered lightweight building block that may be used to make a Quonset hut or similar structures.
Figure 10:
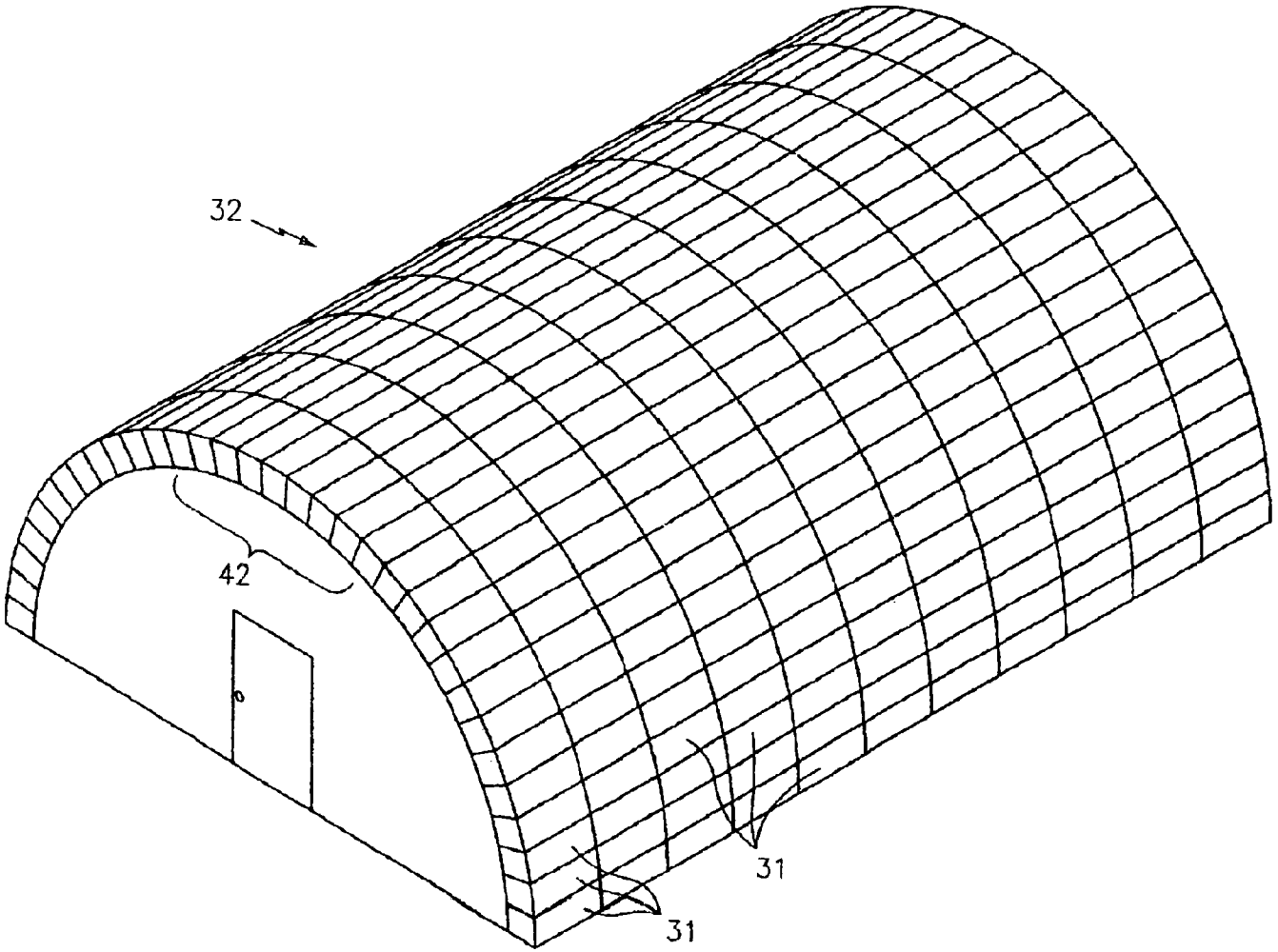
FIG. 10 is a perspective view of a STYROFOAM® Quonset Hut made with a large number of linked tapered building blocks such as those shown in FIGS. 6-9.

FIGS. 6-9 show a tapered lightweight building block 31 that represents a first alternative embodiment of the invention which can be expeditiously used to make a Quonset Hut type of building 32, such as that shown in FIG. 10. As shown in particular in FIGS. 6 and 7, block 31 includes elongated sides 33 and 35, cross-members 37, 39, and 41, and three reinforcing LEXAN® sheets 43 sandwiched between two cross-member sections for each of the cross-members 37, 39, and 41, like the sections 15 and 17 in FIGS. 1 and 3 for the cross-members 7, 9, and 11 of the building block. However, block 31 differs from block 1, in that it is tapered or sloped inwardly from one elongated side to the other from its top to its bottom to form linked arches such as are shown in FIG. 10.

Each tapered block 31 is constructed similar to block 1 of two inch thick BLUE STYROFOAM®, with the nominal external dimensions of its top 33 (FIG. 7) measuring L=16 inches length, $W_1$=8 inches width, and H=8 inches height (FIGS. 8 and 9). But the nominal external dimensions along the bottom of block 31 (FIGS. 7, 8 and 9) measures L=16 inches length (FIG. 7) by $W_2$=a considerably lesser dimension than 8 inches (e.g. 6.50 to 7.0 inches) to provide a curved arch 42 of a varying radius, to be determined by the builder when the blocks 31 are arranged in a Quonset Hut type structure, such as those shown in FIG. 10. It will be understood by those skilled in the art that the bottom dimensions of the tapered blocks 31 (FIGS. 8 and 9) and the varying radius of the curved arch 42 (FIG. 10) may be determined by the design of the structure involved which incorporates the tapered blocks 31.

Figure 7:
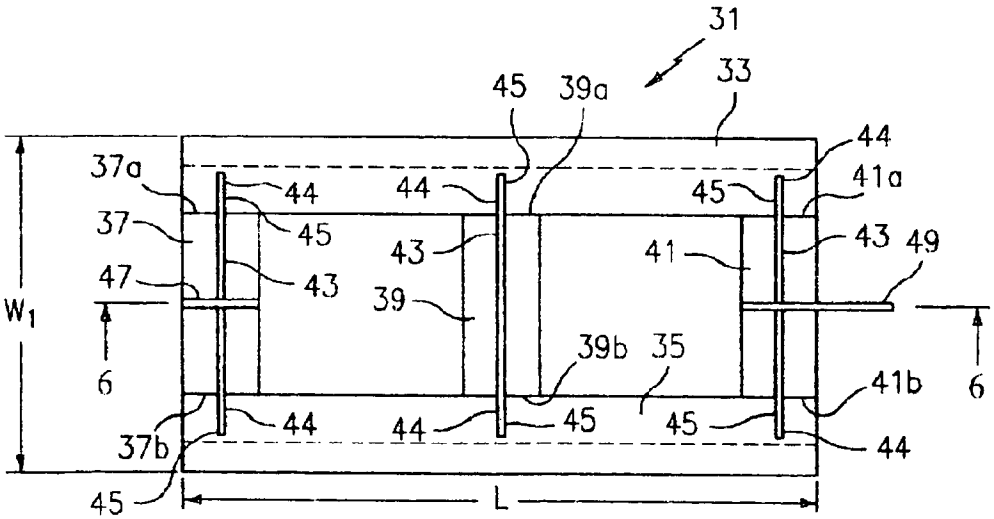
FIG. 7 is a top view of the tapered building block of FIG. 6.

The LEXAN® plastic sheets 43 of reinforcing material are sandwiched and epoxied to cross-members 37, 39, and 41 as shown in FIG. 7. Each of these sandwiched LEXAN® sheets 43 nominally measures H=8 inches height, W=6 inches width, and T 0.125 inches thickness, which allows them to extend outwardly by about 1 inch from ends 37*a*, 37*b*, 39*a*, 39*b*$_9$ 41 *a*, and 41*b* (FIG. 7) of the cross-members 37, 39, and 41, so that they provide protuberances 44 which fit into communicating slots 45 in the elongated sides 33 and 35 of the block 31

To enable a number of the blocks 31 to fit together, an additional 0.125 inch vertical slot 47 is cut into cross-member 37, as shown in FIG. 7, to receive and cooperate with a vertically disposed LEXAN® tongue 49 (FIGS. 6 and 7) that is epoxied to the opposite end slot 47 of the next contiguous block 31, and thereby link the blocks 31 rigidly together. However, the present disclosure contemplates the use of other connectors or interconnecting portions that are known in the art as well. The resulting arches 42 of the blocks 31 may be luted together in a number of segments to form a Quonset Hut type building (FIG. 10). The open ends of the Quonset building may be filled in with the regular lightweight reinforced foam building blocks as hereinbefore described, and windows and doors may be provided in the usual fashion known in the art.

Figure 12:
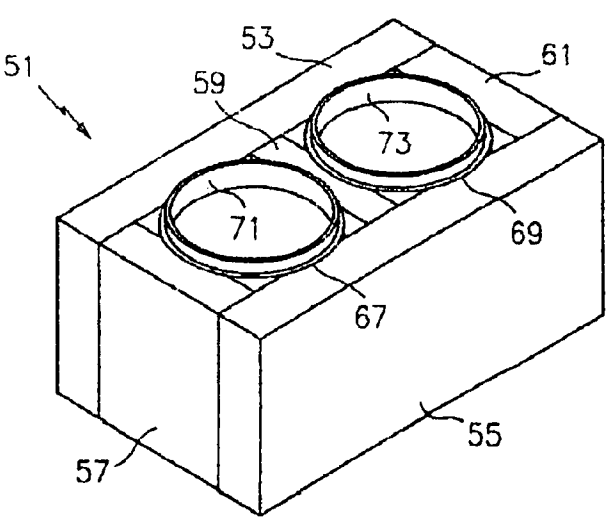
FIG. 12 is a top elevation and end perspective view of the lightweight building block of FIG. 11.
Figure 11:
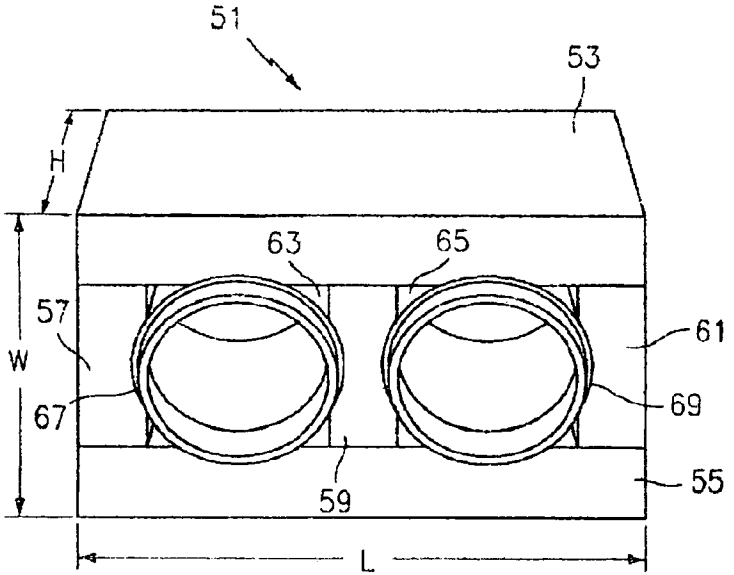
FIG. 11 is a top elevation and perspective view of a second alternative embodiment of the invention, which includes LEXAN® plastic cylinders for reinforcement of the lightweight building block.
Figure 13:
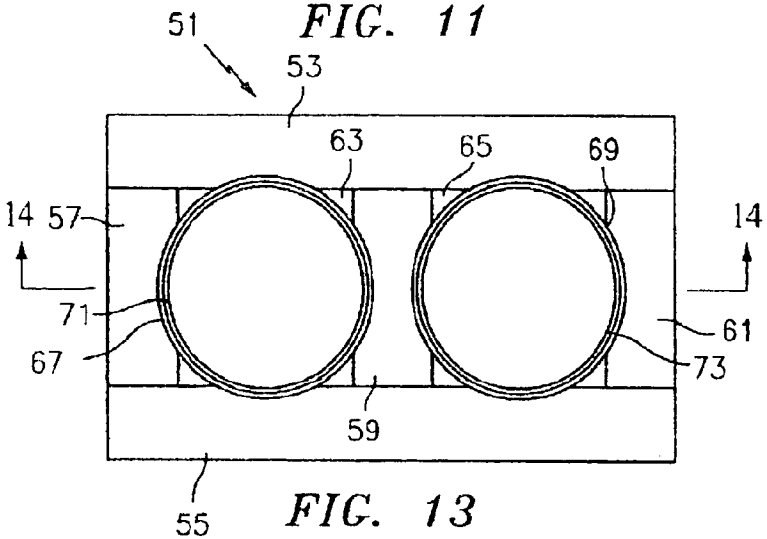
FIG. 13 is a top view of the lightweight building block of FIG. 11.

Turning now to FIGS. 11-14, there is shown a second alternative embodiment of the invention which comprises a different block structure for reinforcement of the STYROFOAM® sides and cross-members than the single planar or flat sheets of LEXAN® or similar plastic material. FIGS. 11 and 13 show lightweight building block 51 with upper and lower elongated sides 53 and 55, which are in spaced apart parallel relationship, have a rectangular shape, are made from two inch thick BLUE STYROFOAM® insulation material, and have the same external dimensions as sides 3 and 5 of lightweight building block 1. The sides 53 and 55 are in perpendicular relationship with cross-members 57, 59, and 61, and are epoxied together to form a lightweight building block 51 which has the same external nominal dimensions as a standard cement building block, where L=16 inches length by W=8 inches width by H=8 inches height, the same external nominal dimensions as the STYROFOAM® building block 1 shown in FIGS. 1-4.

Figure 14:
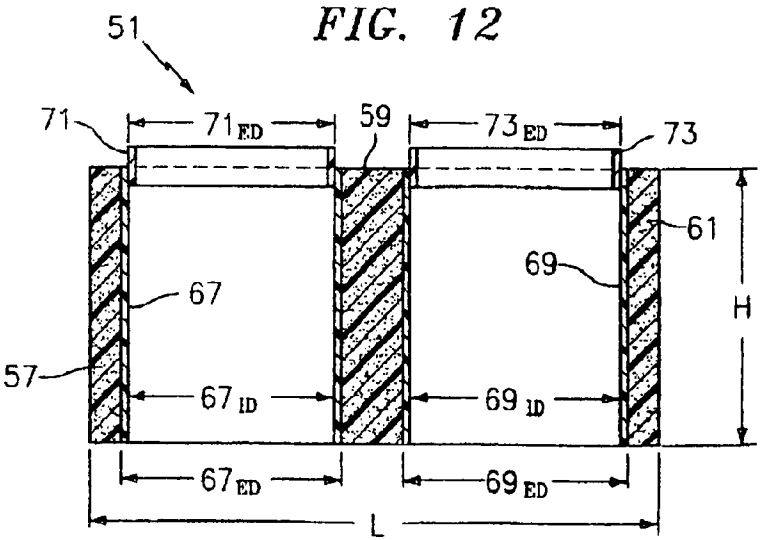
FIG. 14 is a mid-sectional view of the lightweight building block of FIG. 13, taken along the lines 14-14 of FIG. 13.

For the lightweight building block 51, two center cavities 63 and 65 between the upper and lower sides 53 and 55 (as shown in FIGS. 11 and 12) are reinforced by cutting or sizing the contiguous inner walls of the cavities formed by sides 53, 55, and cross-members 57, 59, and 61, to accommodate two reinforcing cylinders or tubes 67 and 69. Within these cavities 63 and 65 respectively, the two LEXAN® cylinders 67 and 69 are disposed and epoxied to the contiguous inner walls. As shown in FIG. 14, the nominal external diameters $\mathbf{67}_{ED}$ and $\mathbf{69}_{ED}$ of the LEXAN® cylinders 67 and 69 are 6 inches, and cylinders 67 and 69 are each 8 inches in height H, and 0.125 inches in their wall thickness, so that the internal diameters $\mathbf{67}_{ED}$ and $\mathbf{69}_{ED}$ of LEXAN® cylinders 67 and 69 respectively are 5.75 inches.

As shown in FIGS. 11, 12, and 14, the cylinders 67 and 69 are positioned and supported within the cavities 63 and 65 by being epoxied to the contiguous inner faces of sides 53 and 55 and the contiguous inner faces of cross-members 57, 59, and 61.

Near the upper ends of cylinders 67 and 69, as shown in FIGS. 12 and 14, they have LEXAN® tubes or rings 71 and 73 inserted and epoxied inside the top margin or top inner wall of the cylinders 67 and 69. The LEXAN® tubes 71 and 73 have external diameters $\mathbf{71}_{ED}$ and $\mathbf{73}_{ED}$ which are 5.75 inches, and they are each one inch long and 0.125 inches in thickness, so their external diameters enable them to fit snugly into the inside of the tops of LEXAN® cylinders 67 and 69. Rings 71 and 73 fit into and cooperate with the bottom margin or bottom inner wall of the LEXAN® cylinders 67 and 69 in the staggered course of a series of reinforced STYROFOAM® blocks 51 above them. The first course of lightweight building blocks 51 would be on solid footing to provide a strong wall of reinforced STYROFOAM® blocks 51. The blocks 51 may be luted or glued together with a compatible cement (such as a silicone adhesive) or other glues.

The weight of the above-described building blocks will vary somewhat depending upon the precise materials such as STYROFOAM® and LEXAN®, which are used in the construction of each block. The weight of the prototype flexible building block 1, which was constructed and tested for this invention, with external dimensions of 16 inches long by 7 inches wide and 9.5 inches high, is approximately 1.50 pounds. The usual weight of a conventional hollow core stretcher type concrete building block having nominal dimensions of 1.6 inches long by 8 inches wide and 8 inches high is approximately 30 pounds. The present disclosure contemplates the use of the building block 1 that has a significantly less weight than the conventional concrete block, such as, for example, less than about 3 pounds and preferably less than about 1.5 pounds as in the embodiment described above.

The building blocks 1, 31 and 51 described herein can also be provided with a coating that adds additional rigidity to the block, and prevents denting of the lightweight portion of the block through use of a stiffer outer surface. An example of such a coating would be to vacuum bag the building block after it is preformed, such as by using a fiberglass cloth over the outside with an appropriate epoxy. The present disclosure also contemplates coating the outer surface of the building blocks for aesthetic purposes, with designs and the like, as well as for facilitating the application of additional aesthetic material to the building blocks. The lightweight portion of the building blocks described herein preferably can also be painted. The building blocks, due to their weight, can also be made in much larger sections. The building blocks may also be covered on the outside of a structure by vinyl siding.

It will therefore be seen by those skilled in the art that the lightweight STYROFOAM® building blocks of this invention could be easily and readily utilized for numerous and varied housing structures and building applications where portability is an important factor, such as military uses, temporary and small outdoor storage buildings, auto garages, boat houses, docks, individual buildings for small aircraft, small single story (e.g. ranch type) homes, and a variety of sports requirements. It should be further understood that the present invention contemplates the use of the building blocks for a variety of structures. The term "housing structure" is not intended to be limiting to any specific type of structure but rather a variety of structures that can provide a variety of functions to the builder, such as, for example, shelter, reinforcement, and/or walls and fences.

It should also be understood that in addition to the significant advantages which the light weight and portability of the blocks of the invention afford, they may also be employed in aggregation to form building structures in locations where adverse weather conditions occur for example, where high winds and/or significant storms abound, arid or in situations where a more dense overall structure is required, by inserting within the cavities of the STYROFOAM® blocks 1, 31, and 51, a wide variety of aggregate materials (i.e. sand or loam) which are readily available at the location involved, to enhance the weight and the density of the overall structure in which the building blocks arc employed.

The various features, arrangements, and applications of the above-described embodiments of the invention may be used in combination with each other or in combination with other building block arrangements, applications and systems previously known in the art. Numerous modifications of this invention will occur to those skilled in the art, and it is understood, therefore, that this invention is not limited to the particular embodiments disclosed, but that it is intended to cover all modifications within the true spirit and scope of this invention, as described in the appended claims.

What is claimed is:

1. A reinforced lightweight foam building block for construction of a housing structure, the building block comprising:

a block outer body constructed of at least a first rigid foam member and at least a second rigid foam member; and at least one cross-member assembly comprising a rigid reinforcing material sandwiched between two rigid foam cross-member sections, wherein said rigid reinforcing material of said at least one cross-member assembly has a first end embedded within and affixed to said at least first rigid foam member and a second end embedded within and affixed to said at least second rigid foam member, wherein the building block is preformed and has a size and shape that allows it to be connected to another building block for construction of the housing structure.

2. The building block of claim 1, wherein said rigid reinforcing material has a high compressive strength.

3. The building block of claim 1, wherein said at least one cross-member assembly includes a plurality of cross-member assemblies.

4. The building block of claim 3, wherein said plurality of cross-member assemblies have at least one cavity formed therebetween.

5. The building block of claim 4, wherein said plurality of cross-member assemblies are disposed substantially parallel to each other and transverse to each of said at least first rigid foam member and said at least second rigid foam member of said block outer body, and wherein an adjacent pair of said plurality of cross-member assemblies are spaced apart by one or more of said at least one cavity.

6. The building block of claim 1, wherein said at least one cross-member assembly has a rectangular shape or a cylindrical shape.

7. The building block of claim 1, further comprising a compressive strength at failure of greater than 8,330 pounds per square inch.

8. The building block of claim 1, wherein said block outer body further comprises a pair of opposing sides that are tapered for conjunctive association with an attachment to other said lightweight building blocks to form a housing structure.

9. The building block of claim 1, further comprising a tongue and groove connector that is partially defined by a portion extending from said at least one cross-member assembly.

10. The building block of claim 1, wherein said at least one cross-member assembly has a height, a width and a thickness, and wherein said height and width are substantially greater than said thickness.

11. The building block of claim 1, wherein said block outer body and said two rigid foam cross-member sections are a polystyrene having a high thermal insulation value.

12. The building block of claim 11, wherein said block outer body and said two rigid foam cross-member sections are affixed to said rigid reinforcing material by an adhesive.

13. The building block of claim 1, wherein said rigid reinforcing material is a polycarbonate.

14. The building block of claim 5, wherein said rigid reinforcing material comprises a sheet of polycarbonate reinforcing material, and wherein said sheet is connected to each of said at least first rigid foam member and said at least second rigid foam member of the block outer body by a plurality of parallel slots formed in each of said at least first rigid foam member and said at least second rigid foam member of said block outer body to accommodate ends of said sheet that protrude from said two rigid foam cross-member sections.

15. The building block of claim 1, wherein said block outer body has six sides made of a lightweight rigid foam, and wherein said rigid reinforcing material that is sandwiched between said two rigid foam cross-member sections prevents displacement of said two rigid foam cross-member sections when the reinforced lightweight foam building block is exposed to pressure.

16. A lightweight building block for construction of a housing structure, the building block comprising:

a lightweight first portion of a rigid foam material having a six sided body; and a rigid second portion of lightweight material having a high compressive strength, said rigid second portion being integrated within said lightweight first portion and affixed thereto to reinforce the structural integrity of the building block, said rigid second portion being disposed between a first cross-section member and a second cross-section member, each of said first cross-section member and said second cross-section member being of said rigid foam material of said lightweight first portion, wherein the building block has a size and shape that allows it to be connected to another of the building blocks for construction of the housing structure, and wherein the building block is preformed and has a weight of less than about 3 pounds.

17. The building block of claim 16, wherein said rigid second portion is a plurality of rigid second portions each being disposed between first cross-section members and second cross-section members, and wherein said plurality of rigid second portions are disposed transverse to a top and a bottom of the lightweight first portion.

18. The building block of claim 17, wherein said lightweight first portion has at least one cavity formed therethrough and said plurality of rigid second portions are disposed substantially parallel to each other on opposite sides of said at least one cavity, and wherein a pair of said plurality of second portions are spaced apart by one or more of said at least one cavity.

19. The building block of claim 16, wherein said rigid second portion has a rectangular shape or a cylindrical shape, wherein said rigid second portion has a height, a width and a wall thickness, and wherein said height and width are substantially greater than said wall thickness.

20. The building block of claim 16, wherein said lightweight first portion is made from a polystyrene having a high thermal insulation value, and wherein said rigid second portion is made from a polycarbonate.

21. The building block of claim 16, further comprising a compressive strength at failure of greater than about 8,330 pounds per square inch.

* * * * *